United States Patent [19]

Wysong

[11] 4,375,214

[45] Mar. 1, 1983

[54] RADIANT FOR GAS HEATERS

[75] Inventor: Charles F. Wysong, Birmingham, Ala.

[73] Assignee: Atlanta Stove Works, Inc., Atlanta, Ga.

[21] Appl. No.: 241,006

[22] Filed: Mar. 6, 1981

[51] Int. Cl.[3] ..... F24C 3/04; F23D 13/12

[52] U.S. Cl. ..... 126/92 AC; 126/86; 431/347

[58] Field of Search ..... 126/92 AC, 92 B, 92 C, 126/92 R, 86, 87; 431/326, 328, 348, 347

[56] References Cited

U.S. PATENT DOCUMENTS 1,668,612 5/1928 Slattery ..... 126/92 AC 2,696,205 12/1954 Ruhl ..... 126/92 AC

*Primary Examiner*—Samuel Scott

*Assistant Examiner*—G. Anderson

*Attorney, Agent, or Firm*—Woodford R. Thompson, Jr.

[57] ABSTRACT

A radiant for use with a gas heater embodies a pair of upwardly converging front and rear walls formed of aluminum silicate. Connector members also formed of a fibrous aluminum silicate refractory board extend between the walls to retain their lower end portions in spaced relation to each other. Perforations are provided in the front wall for emitting radiant heat and an upper vent opening is provided in the rear wall. A convexly curved lower end portion is provided on the rear wall for imparting rotary motion to the burning gases as they move upwardly between the walls.

4 Claims, 4 Drawing Figures

RADIANT FOR GAS HEATERS

BACKGROUND OF THE INVENTION

This invention relates to radiants used in vented or unvented gas heaters and more particularly to such a radiant that is formed from an improved material whereby the radiant is more resilient and gives off increased amounts of radiant heat.

Heretofore, conventional radiants have been formed from a refractory clay material consisting essentially of kaolin and talc. The production of such radiants requires the performance of a number of difficult and time-consuming steps. First, the kaolin-talc composition is mixed with lubricants, binders, plasticizers and organic burnout materials, such as sawdust, to form a wetted mix which is granulated into small nodules which are pressed in dies to form one-half of the clay radiant. Two halves of the radiant are then cemented together to form a complete radiant. Such radiants are then dried and fired to develop good thermal shock resistance which results in a product which is extremely rigid and brittle. This results from the inherent low strength of the kaolin-talc composition and the great number of voids formed within the clay radiant due to the burned out organic materials which are added to reduce the weight and mass of the clay radiant so that the radiant will heat up quickly and glow to thus radiate heat into the area to be heated. While such radiants are light in weight, they are very susceptible to breakage, thus requiring the use of a multiple number of narrow width radiants with each conventional heater. In actual practice I have found as much as ten percent (10%) or more breakage of clay radiants in shipment to customers which results in high replacement costs and bad customer relations.

Also, cone-shaped projections have been provided on clay radiants in position to contact the gas stream to provide high levels of heat shortly after the burner is lit. Such cone-shaped projections are frequently broken off or unformed during manufacture, thus significantly reducing the potential radiant energy.

SUMMARY OF THE INVENTION

In accordance with my invention I overcome the above and other difficulties by providing a radiant for gas heaters which is simple of construction, economical of manufacture, and lighter in weight than conventional clay radiants.

It is an object of my invention to provide a radiant for a gas heater than is more resilient than conventional clay radiants whereby breakage is reduced to a minimum.

Another object of my invention is to provide a radiant for a gas heater that may be manufactured in various sizes and widths whereby a single radiant or a reduced number of radiants may be used with a gas heater instead of using a plurality of narrow width clay radiants.

A still further object of my invention is to provide a radiant for gas heaters which achieves more complete combustion of the gaseous fuel burned therein whereby there is a substantial reduction in carbon monoxide discharged, thus resulting in a safer operation of the heater and an increase in the amount of radiant heat emitted.

My improved radiant embodies a pair of upwardly converging front and rear walls which are formed of a fibrous aluminum silicate refractory board. At least two connector members also formed of a refractory fiber board extend between the front and rear walls to hold the lower end portions thereof in fixed spaced relation to each other. A multiplicity of perforations are provided in the front wall for emitting radiant heat toward an area to be heated with the rear wall having at least one upper vent opening therein.

DESCRIPTION OF THE DRAWINGS

Apparatus embodying features of my invention is illustrated in the accompanying drawings, forming a part of this application, in which.

DETAILED DESCRIPTION

Figure 1:
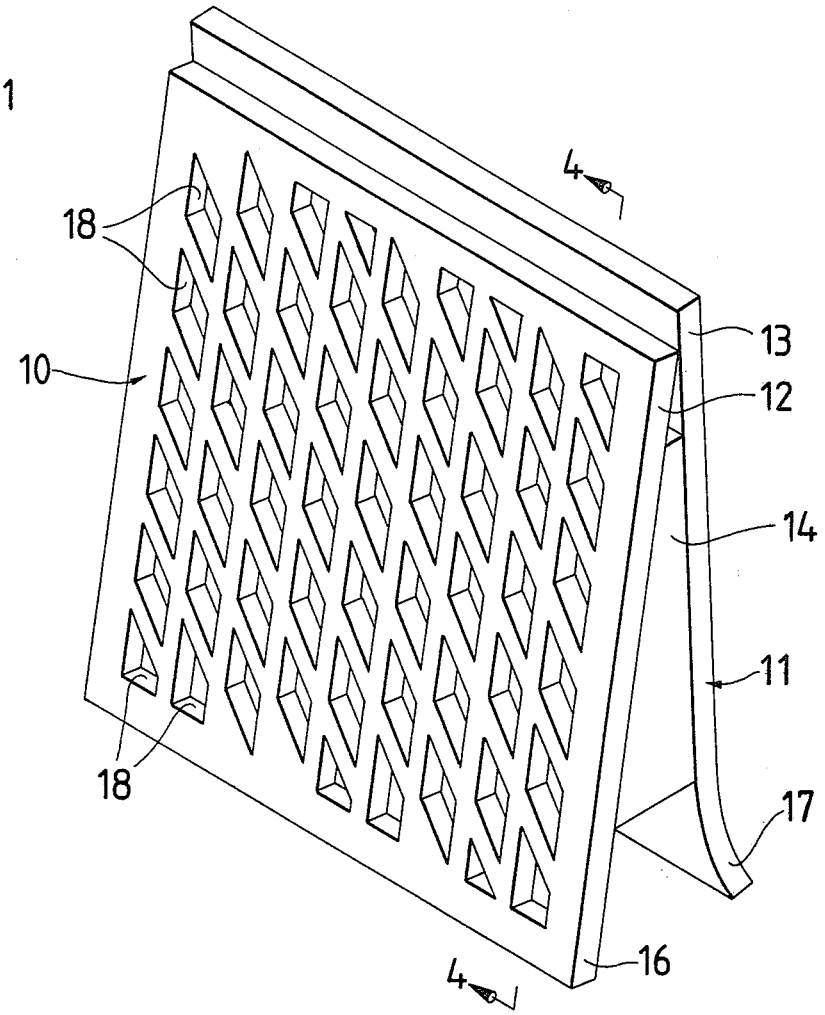
FIG. 1 is a perspective view showing my improved radiant removed from the heater.
Figure 2:
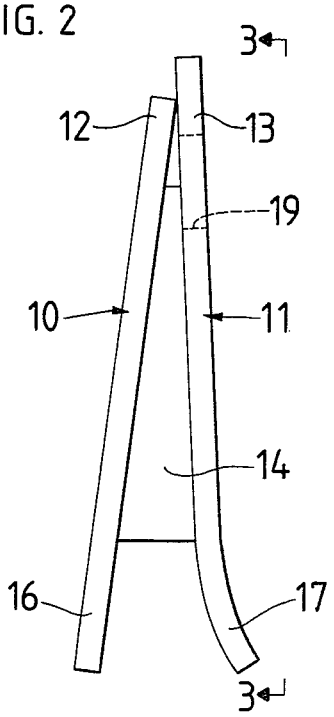
FIG. 2 is an end elevational view of my improved radiant shown in FIG. 1.

Referring now to the drawings for a better understanding of my invention I show in FIG. 1 a pair of upwardly converging front and rear walls 10 and 11, respectively. The walls 10 and 11 are in the form of a resilient, high temperature preformed aluminum silicate fibrous structure. A suitable composition of aluminum silicate is sold under the trade name "CERAFORM" and comprises approximately 39.6% aluminum oxide, 50.7% silicon dioxide, 0.3% ferric oxide, 0.1% magnesium oxide and 0.2% potassium oxide and sodium oxide. The upper end portions 12 and 13 of the walls 10 and 11, respectively, are secured to each other as shown, by a suitable adhesive, such as refractory cement.

A plurality of connector members 14 extend between the walls 10 and 11 in position to hold the lower end portions 16 and 17, respectively, thereof in fixed spaced relation to each other. The connector members 14, also formed from the high temperature composition of aluminum silicate, are secured between adjacent portions of the walls 10 and 11, intermediate the upper and lower end portions thereof, by a suitable refractory cement. While I have shown the connector members 14 as being generally triangular in shape, it will be apparent that they may assume other shapes and forms.

Figure 3:
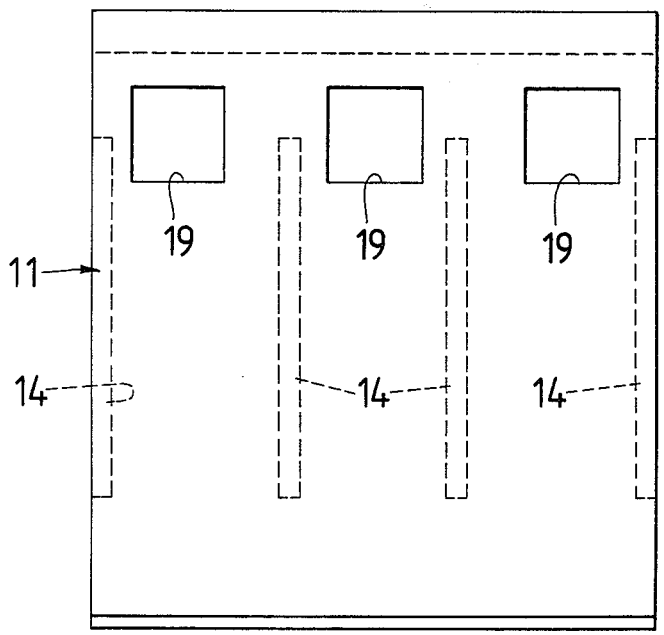
FIG. 3 is a rear elevational view of my improved radiant taken along the line 3—3 of FIG. 2.

FIGS. 1 and 3 show my improved radiant as having a width generally equivalent to that of approximately three conventional clay radiants. My improved radiant may be manufactured into various widths and sizes whereby a single improved radiant or a reduced number of improved radiants may be employed where a multiple number of conventional clay radiants were previously used. Also, at least two, but any number of connector members 14 may be employed between the front and rear walls to hold their lower end portions 16 and 17, respectively, in fixed spaced relation to each other.

As shown in FIG. 1, a multiplicity of perforations 18 are provided in the front wall 10 which emit radiant heat therethrough and then outwardly toward an area to be heated. While I have shown generally diamond-shaped perforations 18, it will be apparent that they may assume other shapes or be formed in other patterns.

FIG. 3 shows a plurality of openings 19 provided in the rear wall 11 adjacent its upper end portion 13. The openings 19 serve as vent passageways. While I have shown the openings 19 as being square openings, it will be apparent that they may assume other shapes or forms, such as a single horizontal passageway.

Figure 4:
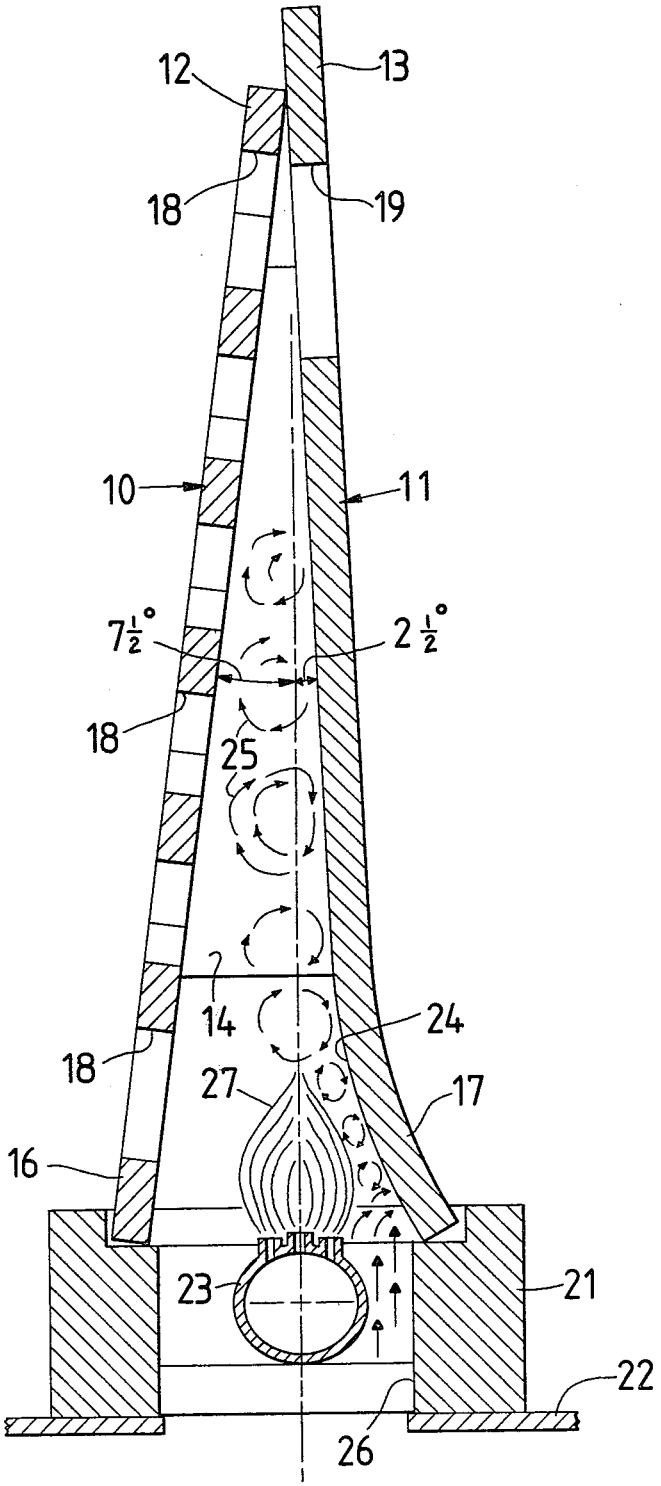
FIG. 4 is an enlarged sectional view taken generally along the line 4—4 of FIG. 1 showing my improved radiant mounted over a burner of a conventional gas heater.

FIG. 4 shows my improved radiant engaging a support member 21 which is usually mounted in the lower portion of a conventional vented or unvented gas heater indicated at 22. A conventional burner 23 adapted to burn a gaseous fuel such as methane, propane, butane and the like is carried by the support member 21 subjacent my improved radiant in an offset relation toward the inner surface 24 of the rear wall 11, as shown. An opening 26 is provided in the support member 21 adjacent the burner 23 which allows ambient air to be drawn upwardly therethrough adjacent the flame 27 ascending from the burner 23 whereby it is mixed with the gaseous fuel and thus supports combustion in the usual manner. As shown, the inner surface 24 of the lower end portion 17 of the rear wall 11 extends downwardly and then outwardly in a convexly curved configuration away from the burner 23 and the front wall 10, whereby it imparts rotary motion to the burning gases as they move upwardly between the walls. Such rotation of the burning gases results in a maximum contact thereof with the rear wall 11 whereby the burning gases impinge on the inner surface 24, as indicated by the arrows 25. The upward movement of the rotating mixture thus creates turbulence between the inner surfaces of the walls 10 and 11. In actual practice, I have found that the turbulence created between the walls results in more complete combustion whereby the carbon monoxide content of the vented fumes is approximately one-half the amount vented by conventional radiants. Also, I have found that my improved radiant produces approximately 25% more radiant heat than that produced by conventional clay radiants.

The walls 10 and 11 are preferably assembled relative to each other so that a vertical plane extending between the walls 10 and 11 and passing through the longitudinal center of the burner defines with the rear wall 11 an included angle of approximately $2\frac{1}{2}°$ and defines with the front wall 10 an included angle of approximately $7\frac{1}{2}°$.

From the foregoing description, the operation of my improved radiant will be readily understood. First, the front and rear walls 10 and 11 and the connector members 14 are cut from a preformed aluminum silicate board to the desired sizes. Next, the perforations 18 and the vent openings 19 are formed in the front and rear walls 10 and 11, respectively. The walls 10 and 11 and the connector members 14 are then fitted together and secured in place by a suitable refractory cement whereby the newly formed radiants are then ready for use. It will be apparent that the manufacture of my improved radiant is greatly simplified over that of conventional clay radiants.

From the foregoing it will be seen that I have devised an improved radiant which is simple of construction, economical of manufacture and more resilient than conventional clay radiants, whereby breakage is significantly reduced. In actual impact tests, my improved radiants were dropped 50 times from heights ranging from $3\frac{1}{2}$ to 10 feet onto a concrete surface without failure as compared with clay radiants which did not withstand one drop from $3\frac{1}{2}$ feet onto the same surface. Also, more complete combustion is achieved with my radiant whereby the radiant heat given off is significantly increased. Furthermore, the operating safety of gas heaters will be greatly increased with my improved radiant due to the significant reduction of carbon monoxide.

While I have shown my invention in but one form, it will be obvious to those skilled in the art that it is not so limited, but is susceptible of various changes and modifications without departing from the spirit thereof.

What I claim is:

1. In a radiant for a gas heater having upwardly converging front and rear walls with means for introducing a gas between the lower portions thereof and having perforations in the front wall for emitting radiant heat resulting from combustion of the gas, (a) said front and rear walls being formed of a fibrous aluminum silicate refractory board with the upper end portions thereof secured to each other and having spaced apart lower end portions, (b) at least two spaced apart connector members formed of a fibrous aluminum silicate refractory board and extending between and connecting said front and rear walls intermediate said upper and lower end portions, and (c) means securing said upper end portions of said walls to each other and securing said connector members to adjacent portions of said front and rear walls to hold said lower end portions in fixed spaced relation relative to each other with the lower end portion of said rear wall extending downwardly and outwardly away from said front wall and defining a convexly curved inner surface adjacent said means for introducing a gas and in position to be contacted by upwardly moving burning gas and impart rotary motion thereto to produce maximum contact of the burning gas with said rear wall as said upwardly moving burning gas impinges on the inner surface of said rear wall.

2. A radiant as defined in claim 1 in which said connector members are generally triangular in shape.

3. A radiant as defined in claim 1 in which a refractory cement secures said upper end portions to each other and secures said connector members between adjacent portions of said front and rear walls.

4. A radiant as defined in claim 1 in which said front and rear walls are assembled relative to each other so that a vertical plane extending between said walls and passing through the center of said means for introducing a gas defines with said rear wall an included angle of approximately $2\frac{1}{2}°$ and defines with said front wall an included angle of approximately $7\frac{1}{2}°$.

* * * * *